United States Patent [19]

Rogers et al.

[11] 4,334,384

[45] Jun. 15, 1982

[54] TOY RAZOR

[75] Inventors: Gregory B. Rogers, Hollywood, Calif.; John R. Wildman, North Riverside; Jeffrey D. Breslow, Highland Park, both of Ill.

[73] Assignee: Marvin Glass & Associates, Chicago, Ill.

[21] Appl. No.: 232,408

[22] Filed: Feb. 6, 1981

[51] Int. Cl.[3] ..... A63H 33/30

[52] U.S. Cl. ..... 46/39; 46/232; 46/189

[58] Field of Search ..... 46/1 R, 39, 227, 228, 46/232, 248, 269, 189, 175 R; 272/8 N

[56] References Cited

U.S. PATENT DOCUMENTS

| | | | |
|---|---|---|---|
| 1,805,566 | 5/1931 | Cipra | 46/189 |
| 2,253,195 | 8/1941 | Oster | 46/1 R X |
| 3,599,367 | 8/1971 | Taylor | 46/248 |

FOREIGN PATENT DOCUMENTS

| | | | |
|---|---|---|---|
| 1104910 | 11/1955 | France | 46/175 R |
| 675808 | 7/1952 | United Kingdom | 46/175 R |
| 1141330 | 1/1969 | United Kingdom | 46/232 |

*Primary Examiner*—Gene Mancene
*Assistant Examiner*—Mickey Yu
*Attorney, Agent, or Firm*—Mason, Kolehmainen, Rathburn & Wyss

[57] ABSTRACT

A toy razor is disclosed which is constructed to be similar in appearance and sound to an electric razor and includes a housing defining an internal cavity within which may be mounted a rotary motor and a power supply such as batteries for energizing the rotary motor. A switch is defined on the housing that connects the motor to the power supply for energization thereof. The toy razor also includes a razor head slideably and reciprocally mounted on the housing. A diaphragm is secured inside the head at a location spaced from the rotary motor such that upon engagement of the shaving head with an object such as the face or hand of a child, the head moves inwardly to vibrate the diaphragm producing a sound similar to the sound of an electric razor.

12 Claims, 3 Drawing Figures

TOY RAZOR

BACKGROUND OF THE INVENTION

A. Field of the Invention

The present invention relates to a new and improved toy constructed to appear and sound like an electric razor.

B. Description of the Prior Art

A favorite category of toys for children are imitations of products used by adults. Such toys allow children to act out activities performed by their parents and other adults. These toys include kitchen equipment and powertools, such as shown in U.S. Pat. No. 4,236,343, as well as others. Another toy in this category of toys is an electric razor. The typical prior art toy electric shaver includes a switch that is connected to batteries that power a noise making device. Such prior art toy razors once energized make a sound that is continuous until being deenergized. Consequently, there is no change in sound while the toy is being held in the hand of the child or when pressed against a surface such as a face of a child to imitate shaving of a beard or the like. This feature detracts from the realistic appearance and sound of the toy.

SUMMARY OF THE INVENTION

An object of the present invention is to provide a new and improved toy that sounds and appears like an electric razor.

Another object of the present invention is to provide a new and improved toy electric razor that makes a realistic sound upon engagement of the toy with a surface such as a face and the like.

The present invention is directed to a new and improved toy that sounds and appears like an electric razor. The toy includes a housing defining a compartment within which are mounted batteries providing a power source for operating the toy. An electric motor is also mounted within the housing and is connected through a switch to the batteries. The switch may be operated to energize and deenergize the motor. Reciprocally mounted on the body is a shaving head that is substantially the same in appearance as a shaving head employed on an electric razor. The shaving head includes a diaphragm attached on the inside thereof that is adapted to engage a protuberance, weight or similar engagement device mounted to the motor and rotated thereby. As a result, upon energization of the motor, an electric motor sound and vibration is created; however, upon engagement of the shaving head on a surface such as a face or the like, the shaving head is reciprocated inwardly of the housing to engage the diaphragm with the weight, thereby creating a realistic hair cutting sound.

BRIEF DESCRIPTION OF THE DRAWING

The above and other objects and advantages and novel features of the present invention will become apparent from the following detailed description of the preferred embodiment of the invention illustrated in the accompanying drawing wherein.

DESCRIPTION OF THE PREFERRED EMBODIMENT

Figure 1:
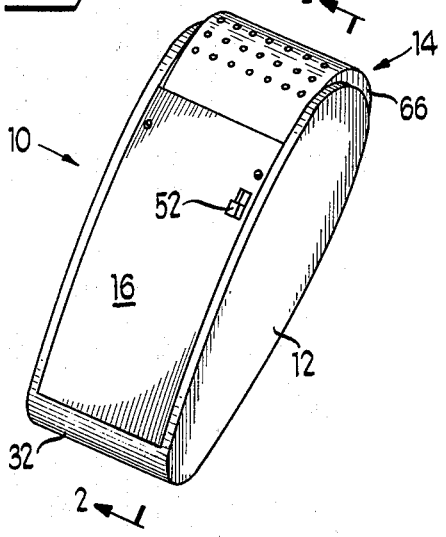
FIG. 1 is a perspective view of a toy constructed in accordance with the principles of the present invention.

Referring now to the drawings, there is illustrated a toy generally designated by reference numeral 10 constructed in accordance with the principles of the present invention. The toy 10 is intended to appear, feel and sound like an electric shaver of the type commonly used by adult men or women. In addition, the toy 10 is intended to feel and sound like a razor in two modes of operation. The first mode being an energized mode of operation wherein the razor produces a humming sound and vibration while it is not applied to skin to be shaved. The second mode of operation occurs as the razor is applied to a surface such as a face and a different sound is created similar to the sound of cutting hair that is heard when an electric razor is used.

The razor 10 includes a housing 12 that is open ended at the top 14. The housing 12 defines a grip portion or handle 16 to which the hand of the child may be applied to grasp and hold the toy razor 10. In addition, the housing 12 defines an interior cavity 18 with structural ribs 20 and 22 that provide the dual function of providing structural strength to the housing 12 and to support first 24 and second 26 batteries that are employed as an energy source. The batteries 24 and 26 are alternately mounted in series to engage a base clip 28 secured by a rivet 30 to the bottom 32 of the housing 12. In addition, the opposite terminal of each battery 24 and 26 is in electrical engagement with electrical contacts 34 and 36 secured by rivets 38 and 40, respectively, to the housing 12.

The electrical contacts 34 and 36 are series connected by wires 42, 44 and 46 with an electrical switch 48 and an electric motor 50. The electrical switch 48 is secured to the interior of the housing 12 and includes a button 52 that extends through an opening or aperture 54 in the housing 12. The switch 48 is an on/off switch to electrically couple the motor 50 to the batteries 24 and 26 and may be actuated between the on/off positions by a child.

The motor 50 is mounted to a structural rib 56 and includes an output shaft 58. A flywheel or weight 60 is mounted on the shaft and includes a protuberance or engagement member 62 on a portion thereof. Upon moving the button 52 of the switch 48 to the on position, the motor 50 is energized causing rotation of the weight 60 and the engagement member 62.

Figure 2:
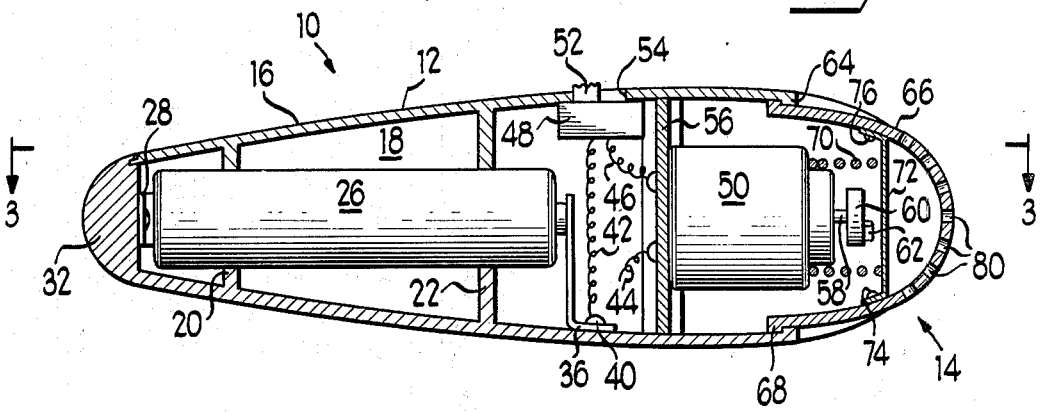
FIG. 2 is an enlarged, sectional view taken along line 2—2 of FIG. 1.
Figure 3:
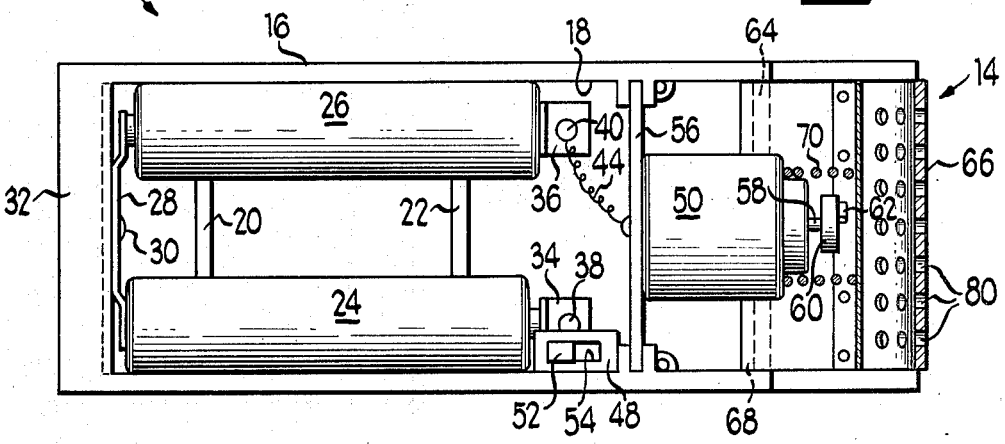
FIG. 3 is a sectional view taken along line 3—3 of FIG. 2.

A flange 64 is defined at the open end 14 of the housing 12. In accordance with an important feature of the present invention, a head member 66 is reciprocally mounted within the opening 14. The shaving head 66 is curvilinear and made of a resilient material such that the ends 68 thereof on which are defined flanges may be mounted within the opening 14 to engage the inner peripheral surface of the housing 12. As best illustrated in FIG. 2, the flanged ends 68 of the head 66 engage the flange 64 and are maintained in this position by a spring 70 that encircles the motor 50 and is biased against a diaphragm 72 secured by rivets 74 and 76 to the head portion 66. In this manner, the head portion 66 is biased outwardly of the interior of the housing 12 to the point where the flange ends 68 engage the flange 64.

Upon engagement of the head 66 with a surface such as the face of a child, the head 66 is reciprocated or pushed inwardly such that the end 68 of the head 66 slides along the inner peripheral surface of the housing 12 away from the flange 64. As this occurs, the diaphragm 72, that in the preferred embodiment is fabricated from fish paper, is pushed against the weight 60 and the engagement member 62. If the motor 50 is energized as this occurs, a noise is created similar to the sound of cutting hair. To further add to the realistic appearance of the toy 10, the head 60 includes a plurality of apertures 80.

The toy 10 constructed as above described provides two modes of operation. In the first mode of operation, the switch 48 is turned to the on position and the sound of the motor 50 creates a sound substantially similar to the idling sound of a razor prior to cutting hair and its associated vibration. In the second mode of operation, the head 66 is pressed against a surface, such as the face of a child, causing engagement of the diaphragm 72 with the engagement member 62 thus creating a noise similar to the cutting of hair.

What is claimed and sought to be secured by Letters Patent of the United States is:

1. A toy razor comprising:

a housing;

a razor head slideably mounted on said housing to allow movement of said head relative to said housing from a first position to a second position upon engagement of said head with an object;

first means for producing a first sound while said head is in said first position, and second means for producing a second sound upon movement of said head relative to said housing.

2. The toy razor set forth in claim 1 wherein said first sound producing means comprises a rotating engagement member mounted on said housing and second sound producing means comprises a diaphragm spaced from said engagement member and mounted on said head.

3. The toy razor set forth in claim 2 wherein said diaphragm comprises a sheet of fish paper.

4. The toy razor set forth in claim 1 further comprising means for biasing said head away from said first sound producing means.

5. The toy razor set forth in claim 1 further comprising means for energizing said first sound producing means.

6. A toy razor comprising:

a housing including an open end and defining an interior chamber;

a motor mounted in said chamber;

flywheel means on said motor including an engagement member mounted thereon to provide an idling sound and vibration as the motor is energized; and a head portion movably mounted adjacent said open end having a diaphragm secured thereto whereby movement of said head relative to said housing causes a second sound to be generated.

7. The toy razor set forth in claim 6 wherein said diaphragm is adjacent said engagement member.

8. The toy shaver set forth in claim 6 further comprising a spring mounted on said motor and between said motor and said diaphragm.

9. The toy shaver set forth in claim 6 wherein said diaphragm comprises a sheet of fish paper.

10. A toy electric shaver comprising:

a hollow housing including an open end;

a motor mounted in said housing;

a weight secured to and rotated by said motor;

a shaving head slideably mounted in said open end; and a diaphragm secured to said shaving head adjacent said weight to be engaged thereby upon engagement of said shaving head with an object.

11. The toy electric shaver claimed in claim 10 further comprising means for biasing said diaphragm away from said weight.

12. The toy electric shaver claimed in claim 10 wherein said diaphragm is fabricated from fish paper.

* * * * *